United States Patent [19]

Van Dusen

[11] 4,260,313

[45] Apr. 7, 1981

[54] SILO DISCHARGE DOOR FRAME FOR USE WITH SILO CLEAN CHUTE FUNNEL

[75] Inventor: Frederick E. Van Dusen, Hopkins, Minn.

[73] Assignee: Van Dusen & Co., Inc., Plymouth, Minn.

[21] Appl. No.: 3,709

[22] Filed: Jan. 15, 1979

[51] Int. Cl.[3] ..... B65G 65/36; E04H 7/22

[52] U.S. Cl. ..... 414/313; 193/34; 52/195; 52/196

[58] Field of Search ..... 414/313-322; 193/34; 52/195, 196

[56] References Cited

U.S. PATENT DOCUMENTS

| | | | |
|---|---|---|---|
| 3,709,345 | 1/1973 | Price | 193/34 |
| 3,797,625 | 3/1974 | Price | 193/34 |
| 4,062,434 | 12/1977 | Price et al. | 193/34 |

*Primary Examiner*—Robert G. Sheridan

*Attorney, Agent, or Firm*—Kinney, Lange, Braddock, Westman and Fairbairn

[57] ABSTRACT

A door frame for use in the discharge doors of silos which is adapted to be quickly moved from one frame to another as silage is removed from the silo, and which will support a hood or funnel used with clean chute systems for discharging silage from the silo. The door frame also may provide a support for the silo unloader, including guides for the normal gooseneck discharge conduit of the unloader and its torque restraining means. The frame provides a rack for receiving and storing the silo door which is removed for installation of the frame. The frame is adjustable to tightly fit into different size door openings. In a preferred embodiment the door frame is raised and lowered into position through the use of a winch and motor assembly, thus making the changing of the movable door frame that supports the hood for the clean chute assembly simple, and relatively labor free.

18 Claims, 13 Drawing Figures

20
120
74
76
75
70
73
71
68A
72
68
21
114
69
69A
66
113
69B
77
64
67
62
112
78
60
112
79
61
112
69B
69
65
33
22
69A
100
95
50
86
31
91B
25
32
26
87
106
28
103
107
82
11
85
27

20
71
72
68A
68
69
114
69A
69B
113
77
67
15
6
112A
79
78
112
69A
69B
65
69
40A
33
61
50
95
51
99
98A
26
52
46
100
25
98
99A
43
42
91B
44
40
45
40A
58
108A
56
108
15
106
82
83
84
85
6
27

70
163
123
164
33
79
99A
99
37
100
123
164
160
31
122A
122
121
164
160
31
164
160
32
103
83
85
85
123
66
123
103
66
Z2
Z2

70
20
163
123
121
122
122A
120
26
123
27
33
100
164
35
160
31
86
103
32
164
85
66

SILO DISCHARGE DOOR FRAME FOR USE WITH SILO CLEAN CHUTE FUNNEL

BACKGROUND OF THE INVENTION

1. Field of the Invention

The present invention relates to discharge devices for silos and more particularly to an adjustable door frame for supporting apparatus used in torque restraint and maintaining a clean chute silo configuration.

2. Prior Art

The use of a double chute assembly, which provides one clean chute for operator access, and another chute or conduit for the discharge of silage has been well known. For example, U.S. Pat. Nos. 3,709,345 and 3,797,625 illustrate this concept. The devices work quite well. However, in the interest of saving labor, when changing the unloader from door to door and at the same time providing a clean working environment, it has been desirable to mechanize and simplify as much as possible. Therefore the need for an easily usable and clean apparatus for making the transfer of the silo unloader from door to door as the silo is being unloaded has existed.

SUMMARY OF THE INVENTION

The present invention relates to a movable frame for doors of silos having mechanical surface unloaders, to support items such as the unloader gooseneck or torque arm, or a funnel which is mounted on silos for clean chutes. Transferring the hoods and any associated silo unloader support members is made a simple job which is relatively labor free.

In the form shown, the door frame assembly includes means for supporting the torque arm and gooseneck of the silo unloader, and further may include a winch control for ease of lowering the apparatus to the next lower silo door. The frame is adjustable as to width and height so that different size doors can be accommodated quite easily, and provides an insert that fits within the door. Quick attaching means for holding the hood or funnel used with the clean chute system are included on the chute side of the frame. The funnel then is utilized with a long plastic sleeve to provide the clean chute function.

Further, in the form shown, both the torque arm and the gooseneck are held in the silo side of the movable frame, one at the upper edge of the door frame and one at the lower edge. This provides for positive control of the silo unloader, and as the unloader is moved downwardly in the silo as silage is discharged, the gooseneck will telescope, as will the torque arm, to accommodate this movement.

The method of changing the location of the frame support for the funnel comprises releasing fasteners that hold the door frame in position, after removing the funnel from the frame assembly, then pushing the lower portion of the door frame inwardly and lowering the frame to the next desired silo door opening after removing the lower door from the silo itself. The door where the hood was previously placed is replaced. The door for the new door opening is stored on the rack on the movable frame. The upper portion of the frame is inserted into the newly opened door opening. The lower portion of the frame is moved outwardly into position, and then the frame is clamped to the silo to hold it positioned.

The device is easy to use, relatively inexpensive, and can be adapted to existing or new silos, as well as a wide variety of different types of silo unloaders.

The process keeps the operator access passageway or chute clean and clear of debris. All openings from the operator passageway to the interior of the silo are sealed during operation of the unloader to insure cleanliness.

BRIEF DESCRIPTION OF THE DRAWINGS

FIG. 12 is a vertical sectional view of the silo of FIG. 10 taken from the opposite direction and showing a modified form of the silo which has a dormer discharge door therein;

FIG. 13 is an elevational view of the device of FIG. 12 taken from the interior of the silo with the door frame supported on a bridge framework above the upper edge of the silo.

DESCRIPTION OF THE PREFERRED EMBODIMENT

Figure 1:
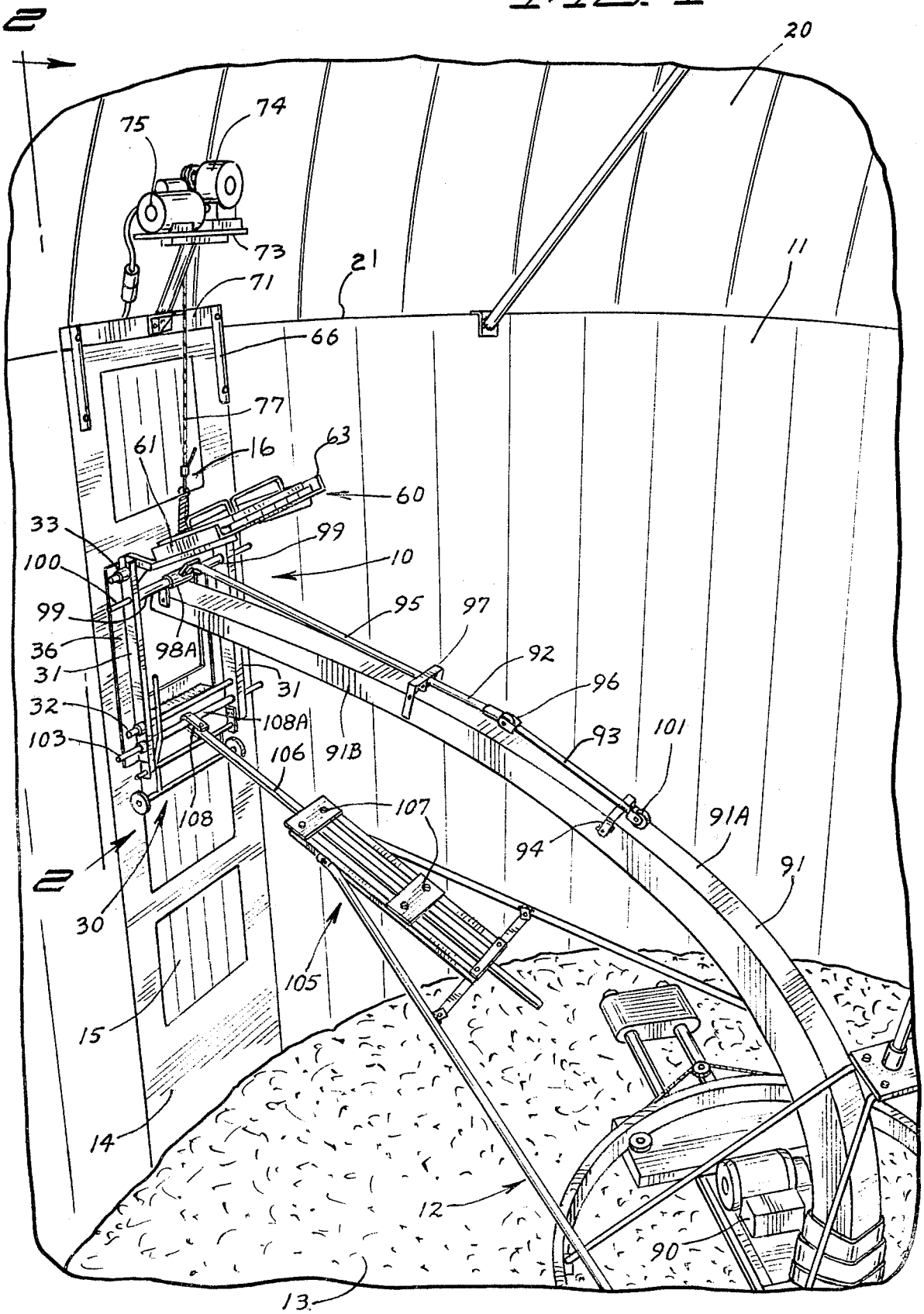
FIG. 1 is a perspective view of the interior of a silo having a door frame assembly made according to the present invention installed therein.

The apparatus of the present invention illustrated generally at 10 is designed for operating inside of an upright silo, the wall of which is indicated at 11, to support and control a silo unloader assembly 12 that is used for discharging the silage 13 out through an open door of the silo.

Normal silo constructions such as that at 11 have a door column indicated generally at 14 which contains a plurality of individual silage discharge door openings 15. Each of the discharge openings 15 is normally closed with a removable door member 16. These door members are generally held in place by suitable latches in the normal manner, and after the silo is filled the doors are removed sequentially from top to bottom during the unloading of the silo 11 with the silo unloader. The unloader discharges through the doors as the silage is removed.

As stated previously, the concept of having a main "clean chute" for operator passage, and providing a second chute within the clean chute for discharging the silage has been found to increase the safety of operation in silos because ladder rungs and door column don't get dirty and also operators stay clean during attending to the silo operation. It has become quite common in the trade to utilize a funnel or hood that will fit into a silage discharge door opening 15 directly and clamp to this door opening, and then use this hood to discharge into an attached long sleeve of plastic which extends down the outer discharge chute of the silo. Generally speaking the frames for the hoods which now exist are exemplified by the clean chute structure as shown in U.S. Pat. No. 3,797,625, except that in place of a relatively rigid pipe shown, it also has now become common to use a plastic tube to provide the silage discharge chute within the main clean operator's chute.

Figure 2:
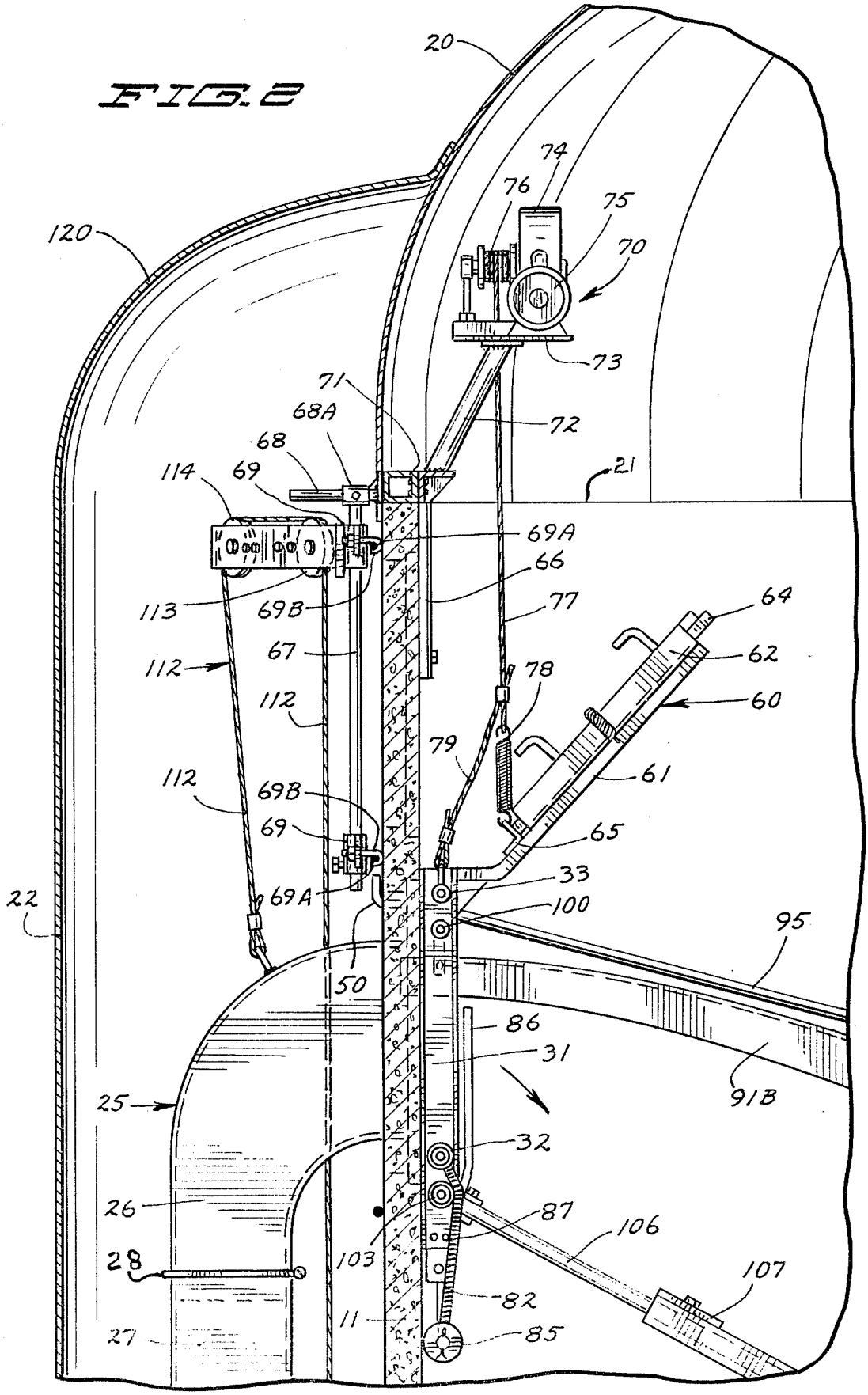
FIG. 2 is a sectional view taken generally along lines 2—2 in FIG. 1.
Figure 3:
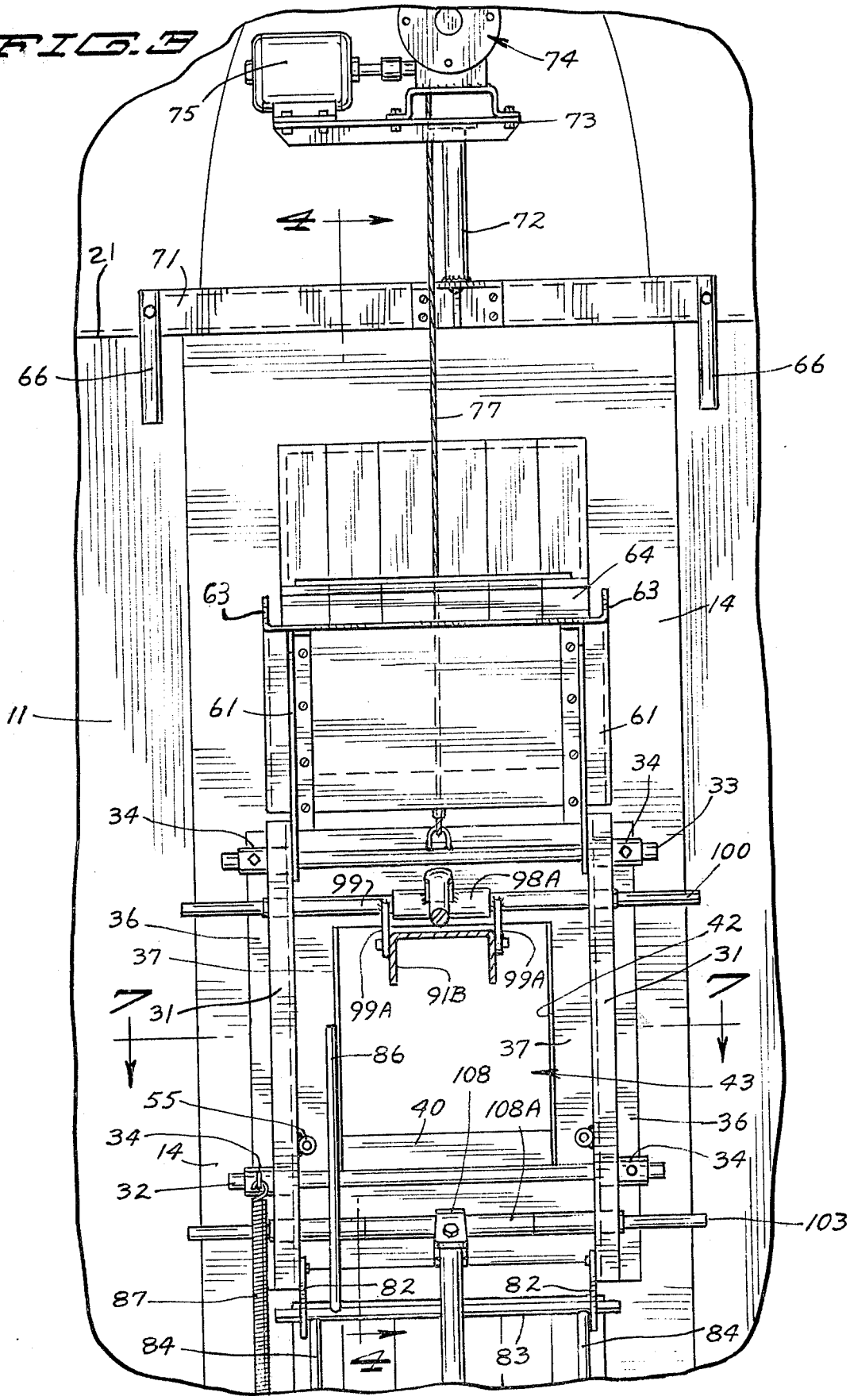
FIG. 3 is a view from the interior of the silo facing the silo doors showing a door frame made according to the present invention.

For example, referring to FIG. 2, it can be seen that the silo wall 11 has a roof structure 20 mounted at the top in a normal manner and fixed to the upper edge 21 of the wall 11. Accordingly, a chute or housing 22 is mounted to the wall 11 and forms a more-or-less "U" shape against the wall to provide a chamber that encircles or covers the door openings 15 in the door column.

The clean chute assembly is indicated generally at 25 and comprises a funnel or adapter hood member 26 that is attached to the chute side of a movable door frame of the present invention. A plastic tube 27 is clamped onto the lower end of the funnel 26 with a suitable clamp member 28.

The silage that is discharged by the unloader is propelled through the interior of the funnel or hood 26, and then through the tube 27 down to the delivery point of the silo (not shown).

Referring again to FIGS. 1 and 2 in particular, the door frame assembly illustrated generally at 30 comprises first and second side upright frame members 31,31 that are held together with suitable cross pipes at the lower end shown at 32 and at the upper end of the discharge door opening at 33. The door side frame members 31 each have suitable collars 34 with set screws to releasably clamp onto the lower and upper pipes 32 and 33 to provide for lateral width adjustment of the frame members 31.

The side upright frame members 31 have vertical side flange members 35 which fit along the inside edges of the discharge door frame openings 15 (refer to FIG. 7), and the upright frame members 31 have laterally extending flanges 36 that are positioned on the interior of the silo and bear against the interior surface of the silo when the door frame assembly 30 is in latched position.

Figure 4:
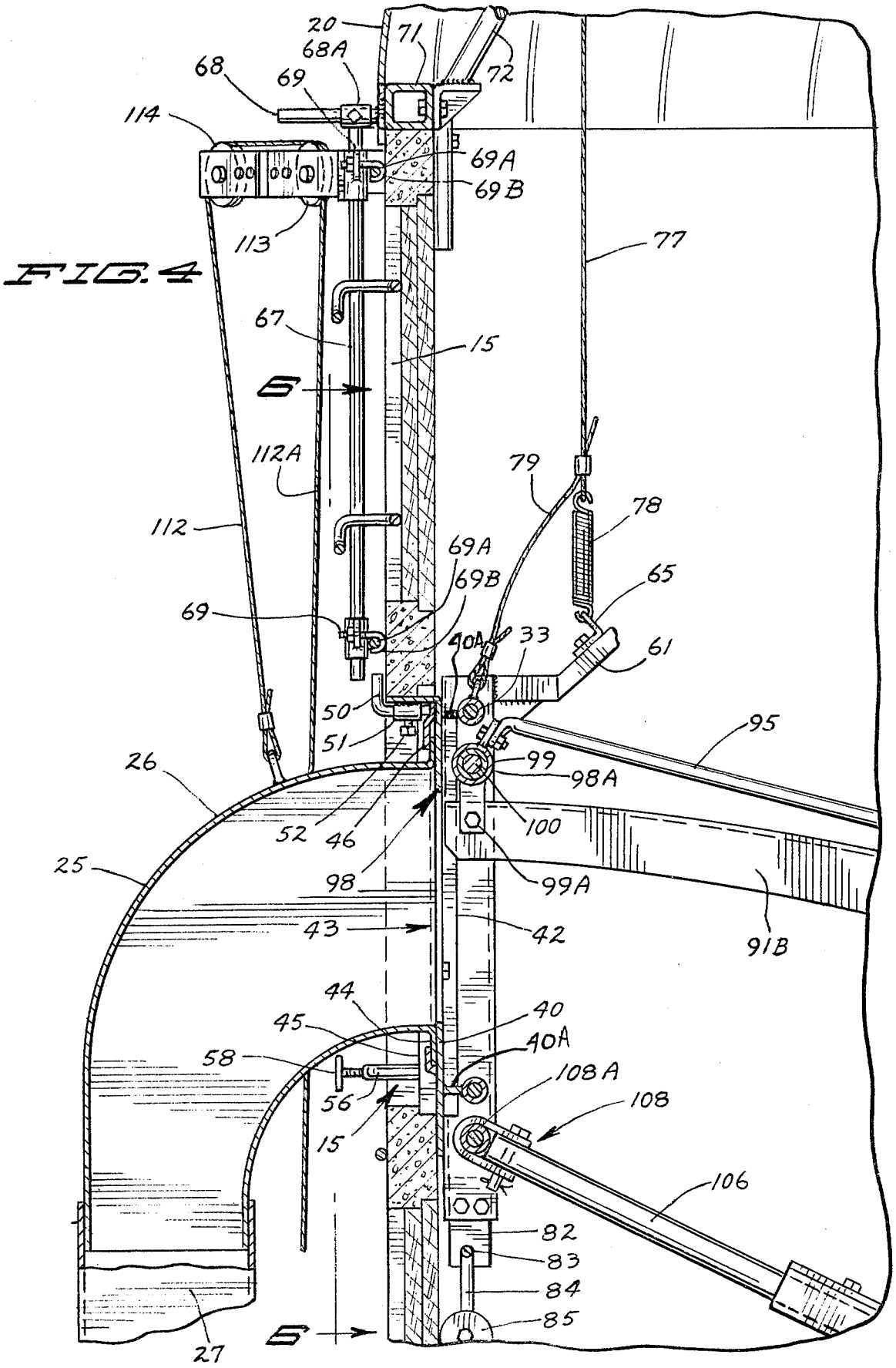
FIG. 4 is a sectional view taken as on line 4—4 in FIG. 3.

The side frame members 31,31 can be adjusted toward and away from each other by releasing and reclamping the collars 34 on the respective cross pipes to fit individual door openings 15. A face plate 40 is mounted to the pipes 32 and 33 with supports 40A (see FIGS. 4, 5, and 7). The filler blocks 37 are attached to plate 40 with suitable sheet metal screws 41. The filler blocks 37 are made to be of size to fill the space between the edges of plate 40 and the side frame member 31. The plate 40 is made narrow enough to accommodate the small door openings. The face plate 40 has flanges 42 (see also FIG. 8, and 4) that define the side of a discharge opening 43 in the plate through which silage will be discharged. This discharge opening 43 aligns with the inlet and mounting end of the funnel 26. The mounting end of the funnel 26 has a peripheral flange 44 that defines the opening to the funnel. It can be seen that the opening 43 is substantially the same size as the opening to the funnel 26 (see FIG. 4). The face plate 40 extends upwardly and downwardly so that it will extend beyond the upper and lower edges of most silo door openings in general use.

The support for the funnel comprises an upwardly open, lower slot forming bracket 45 that is attached to the face plate 40 and an upper, downwardly opening bracket 46. The lower bracket 45 receives the lower edge portion of the funnel flange 44. In order to insert this lower portion of a flange 44 into the bracket opening 45, it is necessary to push the funnel into position so that the upper portion of flange 44 of the funnel fits into the bracket 46, and then slid up sufficiently far so that the lower edge of the lower portion of flange 44 adjacent the bracket 45 will slip past the bracket 45 and can be dropped down into the slot to its position shown in FIG. 4. The funnel 26 is thus held tightly against the face plate and is supported in this manner during use.

Figure 7:
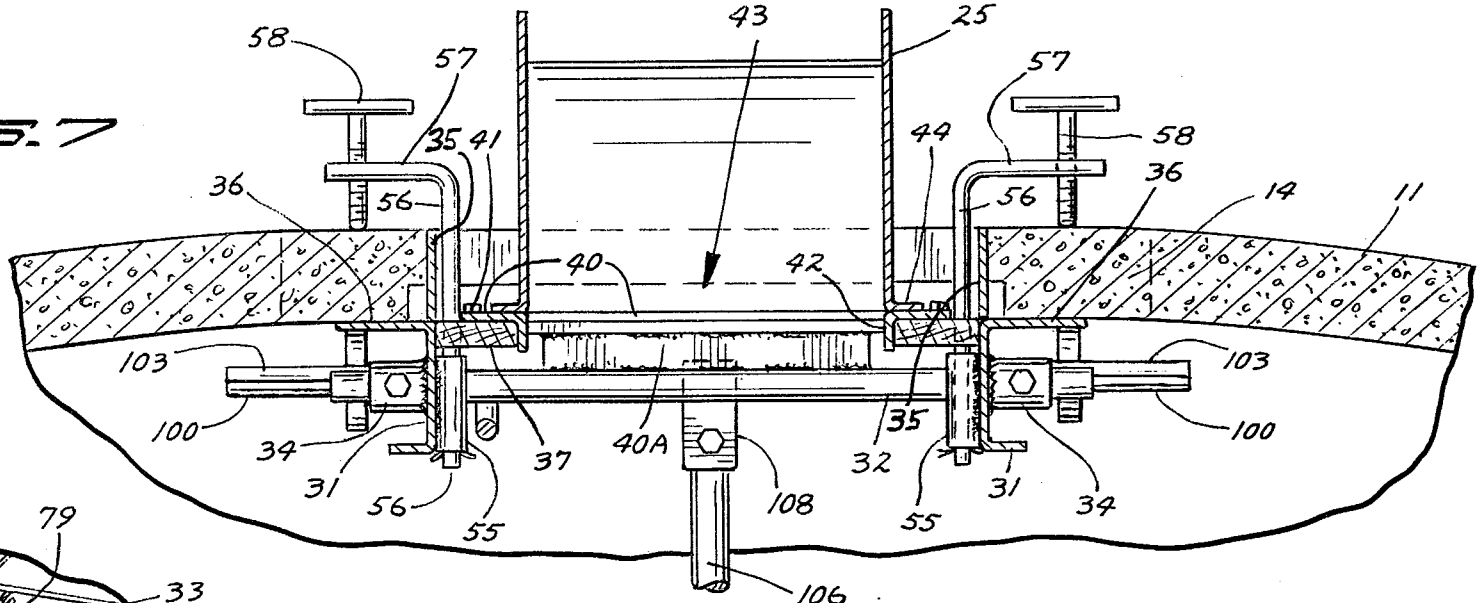
FIG. 7 is a sectional view taken as on line 7—7 in FIG. 3.
Figure 8:
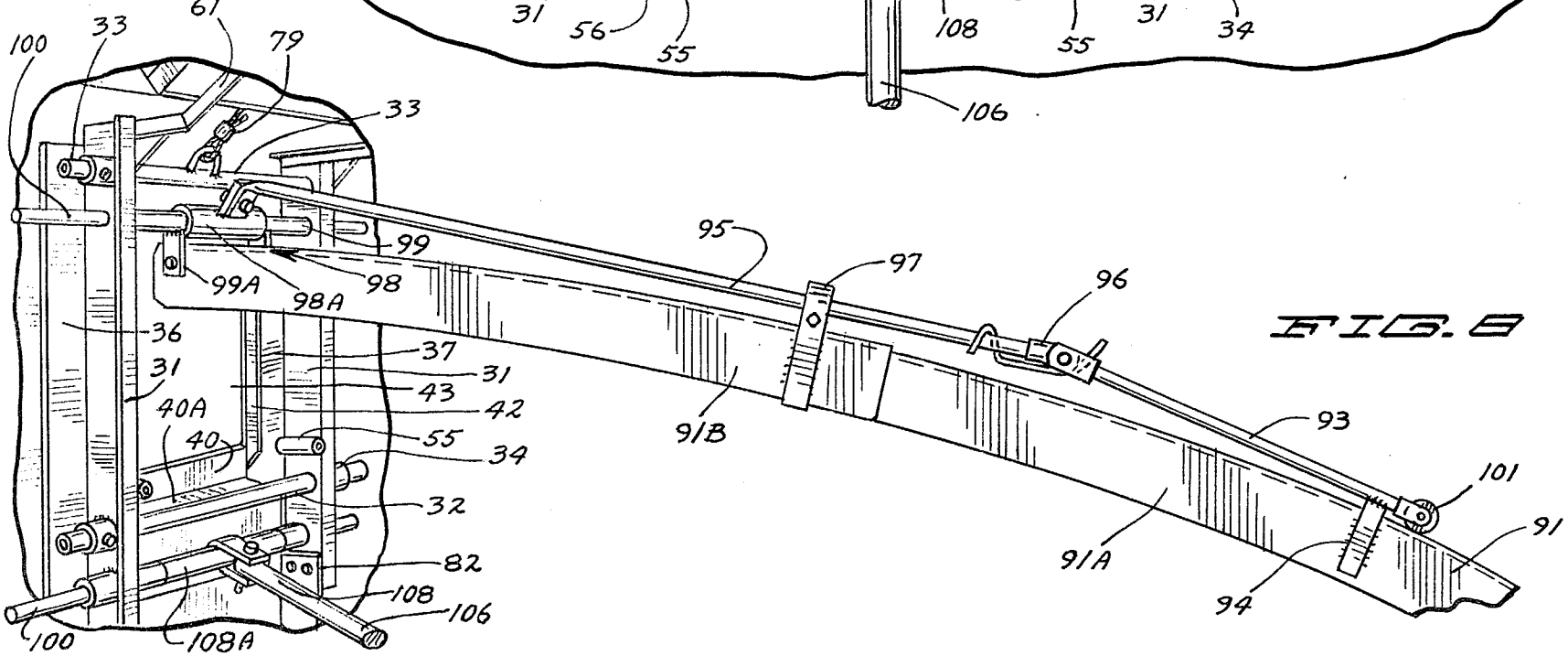
FIG. 8 is a fragmentary enlarged perspective view of the gooseneck discharge chute for the silo unloader that is discharging out through the door frame of the present invention.

A pair of adjustable hooks 50 are mounted in suitable sleeves 51 adjacent the upper ends of each of the frame members 31, and specifically at the inner sides of the upright guides 35 of the frame members 31. The hooks 50 are positioned so that they are at the upper end of the frame members 31 and have their hook ends extend upwardly from the door opening 15 in which the frame assembly 30 is being mounted. A sleeve 51 is provided with adjusting screws 52 to permit the spacing of the hook portions of the hooks 50 relative to the flanges 36 to be changed to accommodate different thicknesses of the wall of the door column 14. It should be noted in FIG. 4 that these hooks 50 span the wall and hook on the outside of the wall. The flange 36 as shown in FIG. 7 is positioned on the inside of the wall of the door column 14.

Adjacent the lower portions of the frame 31, and on the interior side of the frame spacers or fillers 37 there is a tube 55 mounted on each of the frame members 31. These tubes 55 rotatably carry adjustable clamp members indicated at 56 which pass through the spacer or filler members 37, and have hook or leg portions 57 that extend to the outside of the door column 14. The hook or leg portions 57 have clamping screws 58 threadably mounted therein. The main shank portions of the clamps 56 are rotatably mounted in the sleeves 55, so that they may be rotated to place the hook portions 57 to the interior of the discharge door opening 15, and thus to the interior of the flanges or guides 35, for insertion of the frame assembly 30 into the desired door opening. The hook portions 57 then may be moved to their positions as shown in FIG. 7, for example where the legs 57 are on the outside of the door column and extend laterally out from the door opening 15. The clamp screws 58 can be tightened down to bear against the outer surface of the wall of the door column to pull flanges 36 against the interior surface of the silo and to thus hold the frame assembly 30 tightly in place, in cooperation with the hooks 50.

At the upper ends of the frame members 31, there is a silo door storage support assembly indicated at 60. This support assembly comprises a pair of side frame members 61,61 which are mounted to the respective side frame members 31 for the main support frame, and a tray indicated at 62 is mounted to these frame members and extends therebetween. The tray 62 has flanges indicated at 63 along three sides. One door for the silo, comprising the removable silo door indicated at 64 is placed into this tray when the frame 30 is in position in that discharge door opening 15. The frame members 61 are connected together with a cross member 65 adjacent the base of the support 60.

Figure 10:
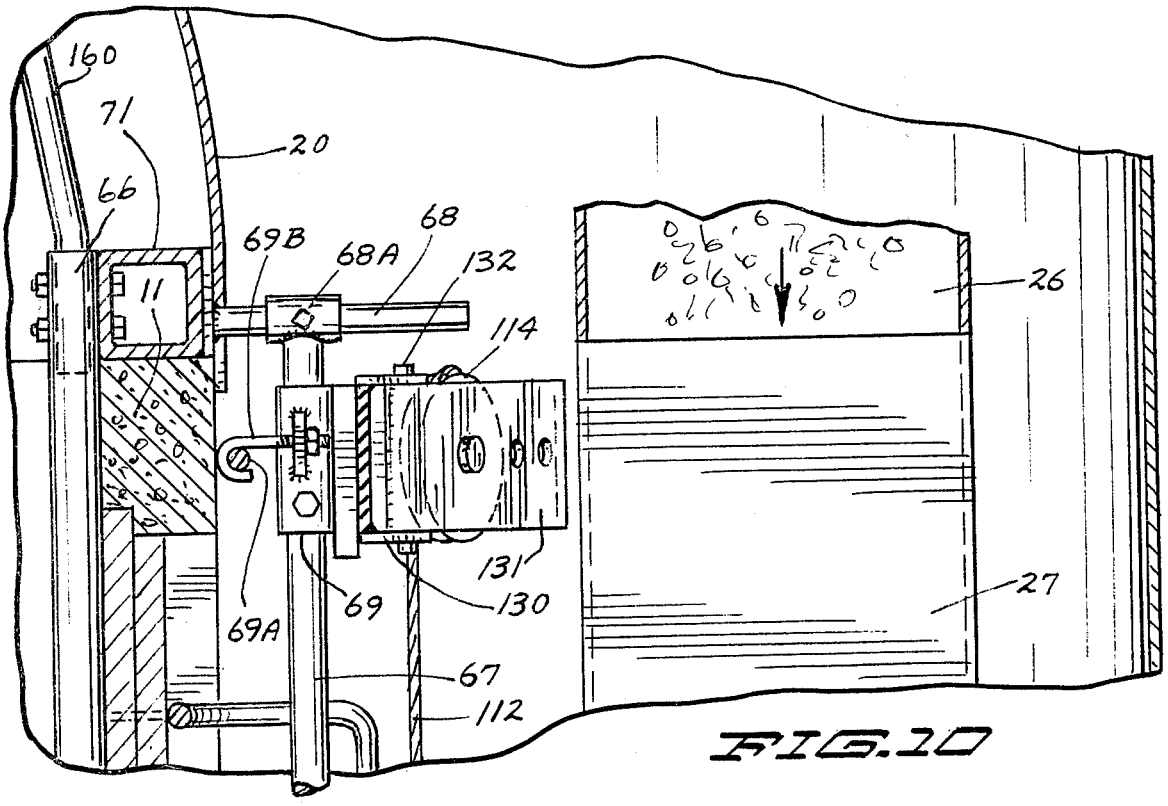
FIG. 10 is a sectional view taken as on line 10—10 in FIG. 9.
Figure 23:
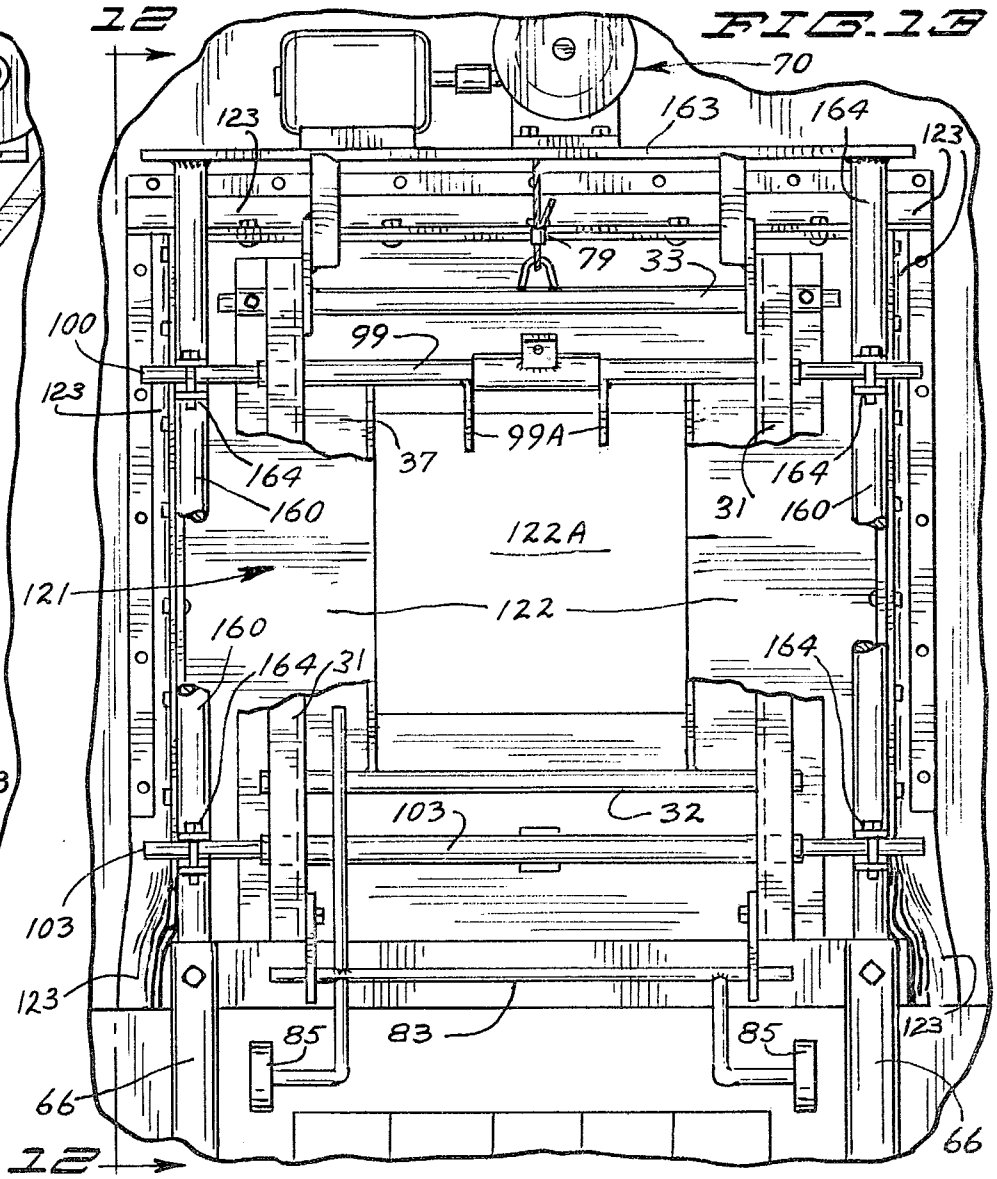
Figure 22:
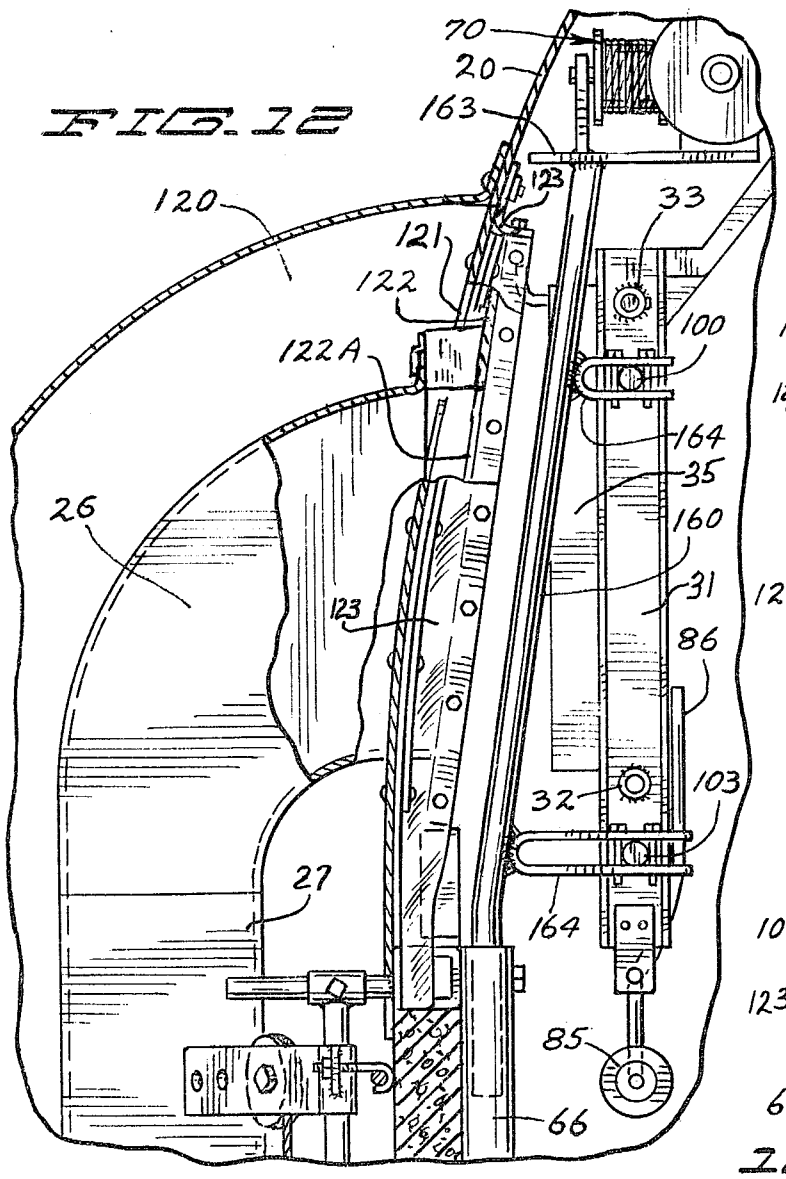

In a preferred embodiment, the frame assembly 30 can be raised and lowered through the use of a motor driven winch. Such a winch is shown generally at 70, and as can be seen is mounted on a cross support tube 71 that is placed above the door column of the silo and rested on the top edge 21 of the silo wall. The tube 71 has four downwardly extending vertical tubular legs fixed thereto to form a saddle that mounts the tube 71 over the upper edge of the silo and door column. As shown short tubular legs 66 are mounted inside the silo and long tubular legs 67 are on the exterior of the silo. Legs 67 are adjustably mounted on horizontal rods 68 (see FIGS. 4 and 10) with sleeves 68A held in place with set screws. The legs 67 pass through clamp sleeves 69 which are attached with two J bolts 69B to the top hoop 69A used to hold the silo staves together and a second hoop 69B about thirty inches lower. The sleeves 68A and 69 are adjusted to tightly hold the tube 71 in place resting on the upper edge of the door column 14. The long tubes 67 react the loads on tube 71 from the interior of the silo.

Tube 71 in turn supports a pedestal 72 that has a platform 73 at its upper end, and a motor driven winch assembly 74 is mounted on the platform 73. The winch assembly includes an electric motor 75, driving a winch drum 76 through a suitable gear box. The winch drum controls a winch or hoist cable 77. Cable 77 is used for lowering the frame assembly 30 between individual door openings, and for lifting the frame assembly to the top of the silo prior to filling. The cable 77, as can be seen, is attached to a tension spring 78 of suitable length and strength. The opposite end of the spring 78 is hooked to the cross member 65. A safety cable 79 is connected between the end of the cable 77 and the upper cross pipe 33. When the silo doors are hinged, and not removed, the door support is not used, and one frame 31 will be notched to clear the hinge structure. However, a cross member 65 will be attached through suitable brackets to provide a support for attaching the cable 77.

The lower end of the frame members 31,31 each carries a support bracket 82. The brackets 82 are bolted to the frame members 31, and the brackets pivotally mount a cross rod 83. The cross rod or shaft 83 in turn has a pair of downwardly depending generally L shaped axle members 84 at the opposite ends of the rod.

Figure 5:
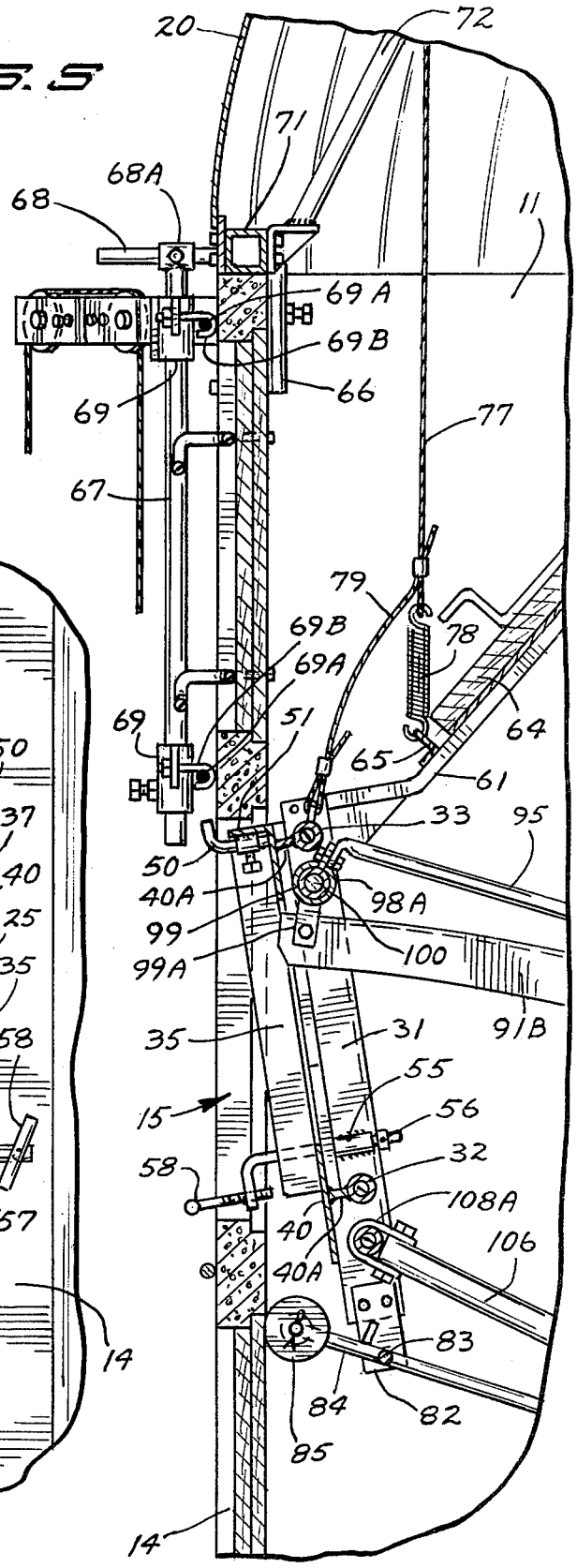
FIG. 5 is a sectional view substantially on the same line as FIG. 4 illustrating a door frame assembly made according to the present invention in the process of being moved from one silo door to another.
Figure 6:
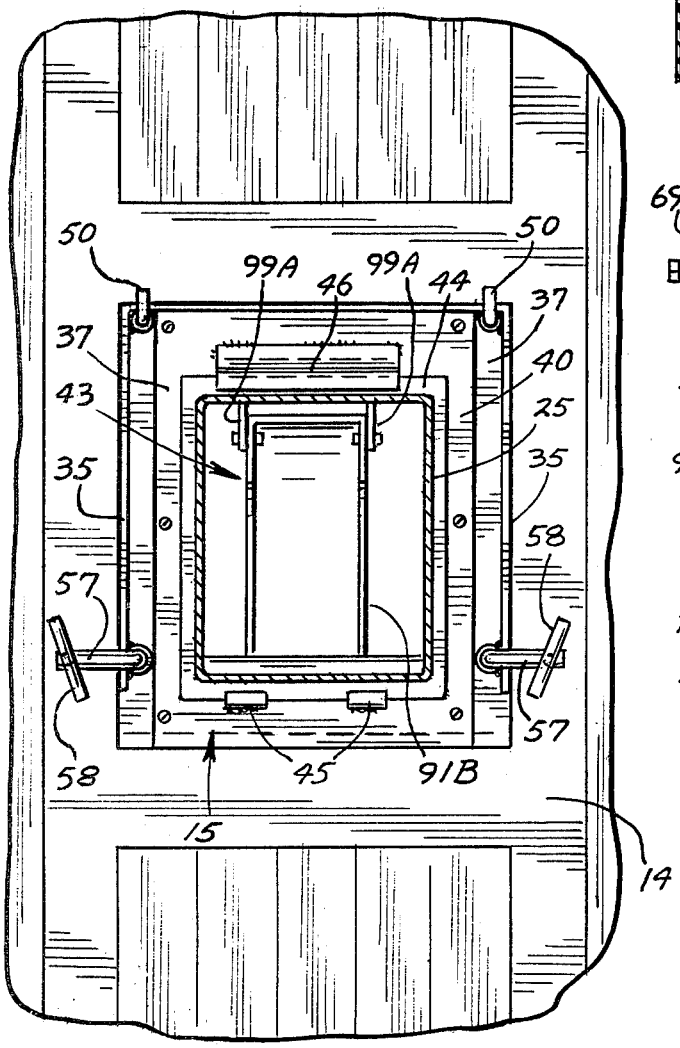
FIG. 6 is a front view taken generally along line 6—6 in FIG. 4.

The long leg portion of the "L" axles 84 extends downwardly from the cross rod or shaft 83, as shown. The short bent over legs or ends of the "L" axles are at right angles to the main legs and extend laterally outwardly from the supports or brackets 82. Each of these short legs or ends rotatably mount a roller or wheel 85. As shown the shaft 83 is provided with an operating lever 86 that extends upwardly from the shaft 83. When the frame 30 is installed in the door opening, the lever is in its position as shown in FIG. 2, and the wheels 85 are spaced inwardly from the outer edges of the door column. When the lever 86 is pulled downwardly it will force the wheels or rollers against door column 14 and will force the lower ends of the frame members 31 away from the interior surface of the door column 14. The rollers or wheels 85 will ride against the interior surface and will prevent the lower end of the frame assembly 30 from hooking on irregularities in the interior surface of the door column. A spring 87 is connected from one collar 34 to one axle 83 and goes "over-center" to hold the rollers or wheels in retracted position of FIG. 2. A working position is shown in FIG. 5, and the frame lower end is spaced from the door column. Stops on bracket 82 limit pivoting of the axles.

Also, in the preferred form of the invention, the silo unloader 12 includes a silage gathering and discharge mechanism 90 (see FIG. 1) that will provide silage to be discharged to a gooseneck or a discharge conduit undicated at 91.

The gooseneck is modified from conventional devices by including a base section 91A and a telescoping outer section 91B. The outer section telescopes relative to the base section, and is guided and supported with a spring loaded, guide rod arrangement indicated generally at 92.

As can be seen, the guide rod 92 includes a first section 93 that is connected to a saddle bracket 94 that is slidably mounted over the base section 91A of the gooseneck. The guide rod assembly includes a second section 95 which is connected to the first section at a pivot joint 96. The second rod section 95 is supported in an intermediate guide bracket 97, attached to gooseneck section 91A and has rollers that guide the second guide rod section 95 so that the section 95 can move longitudinally relative to the bracket 97. The bracket 97 is mounted to base section 91A of gooseneck 91 adjacent the outer end of section 91A. The bracket 97 permits gooseneck section 91B to telescope relative to gooseneck section 91A.

The opposite end of the guide rod section 95 is connected to a bracket assembly 98 which, includes a pivot tube 98A positioned over a cross tube 99 which in turn is pivotally mounted over a rod 100 that extends through the side frame members 31. A pair of depending ears 99A are fixed to cross tube 99 at opposite ends of the tube 98A. The ears are connected with suitable screws directly to the side flanges of the outer end section 91B of the gooseneck. The cross tube 99 centers the gooseneck and the bracket 98 to pivotally hold the gooseneck in precise center position. Spacers may be used at the ends of cross tube 99 if the frame is changed in width.

The "knee" pivot joint 96 of the guide rod assembly includes a torsion spring assembly which tends to urge the two guide rod sections 93 and 95 of the guide rod assembly to bend upwardly.

The end of the guide rod section 93 of the guide rod assembly 92 adjacent bracket 94 has a roller 101 rotatably mounted in a bracket. The roller provides a rolling support tending to carry loads from pivotal movement of the guide rod assembly 92 during vertical movement of the unloader as it moves down during unloading. The bracket tube 98A and tube 99 independently pivot as the silo unloader moves downwardly.

The silo unloader assembly also includes a radial torque arm member shown generally at 105, which resists rotational movement of the stationary portions of the silo unloader and reacts the force necessary to rotate the normal silage gathering augers or mechanism. The torque arm is normally fastened to a door opening with a separate bracket. The torque arm in its disclosed form has an end tubular member 106 that is longitudinally slidably mounted in suitable supporting brackets 107 which in turn are mounted onto the main portion 105 of the torque arm. The outer end of the tube member 106 is pivotally mounted with an upright pin onto a suitable bracket 108 which includes a sleeve section 108A that is rotatably mounted on a tube 103 at the lower end of the frame members 31. Spacers may be used to center the sleeve 108A between frame members 31 to accommodate width adjustments. The torque arm may pivot down relative to the frame assembly 30 as the silo unloader moves silage out of the silo. The silo unloader shown in FIG. 1 is approaching the level of door change from the door supporting the frame 30. The frame assembly 30 may be lowered down to one of the lower discharge door openings, for example, the lowermost door opening 15 shown in FIG. 1.

When the silo unloader is up higher in relation to the door opening in which the frame assembly 30 is positioned, the total length of the gooseneck is less, and in order to accommodate this difference in length, the two sections 91A and 91B of the gooseneck will telescope in any desired manner and the pivot joint 96 will tend to bend like a knee to accommodate this movement. The guide rod section 95 will slide relative to the bracket 97, roller 101 and saddle bracket 97 will slide along section 91 of the gooseneck.

The funnel 26 can be manually raised and lowered inside the main chute 22 through an arrangement comprising a rope 112, mounted over a first pulley 114, and thence over a second pulley 113 so that the rope extends with a length 112A back down toward the ground for operation. The rope can be attached to the funnel 26 in a desired manner. The funnel is counterbalanced by a weight on rope length 112A so it will stay at a desired level and is easily operated by a person standing on the rungs which form a ladder and which are part of most of the common silo doors.

In a modified form of the invention, as will be explained, silage is initially discharged out into an upper dormer portion indicated at 120 of the silo chute 22, which is above the upper edge of the silo walls, before silage is discharged through any door frame assembly. In such a case, an opening is cut into the silo roof, and such an opening is shown at 121 in FIG. 12. The opening has a closure which provides an adequate seal and comprises a support plate 122 attached to the silo roof and a flexible seal such as flexible belting indicated at 123 is provided around the plate 122 and fastened with strips to the silo roof to prevent air from flowing into or out of the silo. The plate 122 is made to provide a standard opening 122A similar to opening 43. Clips to hold funnel 26 in place are provided. Silage can be discharged through opening 122A as shown in FIG. 12. This initial discharge is only for a limited time when the silo is very full.

Figure 9:
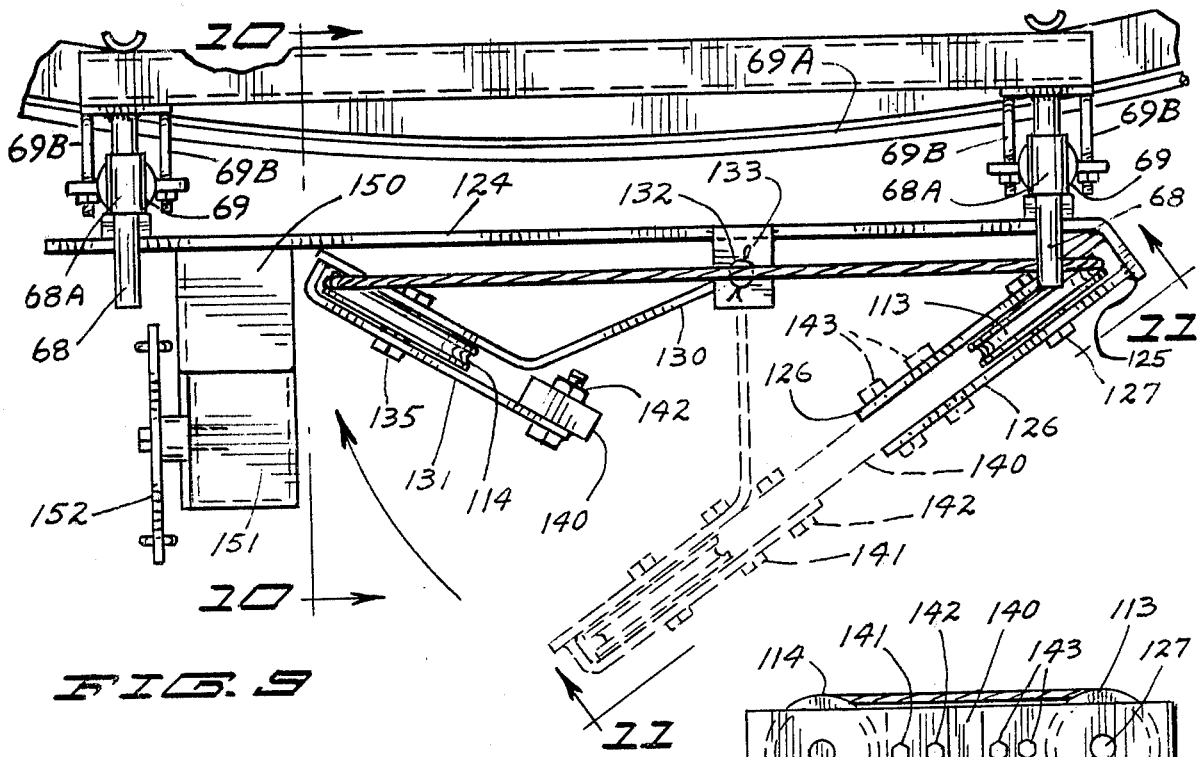
FIG. 9 is a top plan view of the support and control pulley assembly used for raising and lowering a hood used with the clean chute assembly.

It should be noted that when the silage is being discharged in this manner, if the pulley assemblies 113 and 114 are left in working position as shown in FIG. 2, the pulley 14 would get in the way of the "clean chute" funnel and the plastic tube used for the clean chute. Therefore, the pulley support for pulleys 113 and 114 is made so that it will be movable out of the way. The pulley support includes a member 124 which is attached to portions of the upper clamps 69 which holds legs 67 and top tube 71 in place. The pulley support member 124 extends laterally across the door column and has a bent-out end 125 at the right end thereof as seen in FIG. 9. A pair of spaced apart, parallel straps 126,126 are welded to end portion 125 to provide for positioning of pulley 113 therebetween. The pulley 113 is then mounted onto a suitable pivot bolt or pin 127 that passes through the straps 126.

The pulley 114 also is positioned between a pair of support members indicated at 130 and 131, respectively. The support member 130 is bent at an angle in its midsection, and is pivotally mounted through a suitable hub or tube to an upright pin 132 that is mounted in suitable brackets 133 attached to the frame member 124. The pulley 114 is mounted on a suitable pin or bolt 135.

Figure 11:
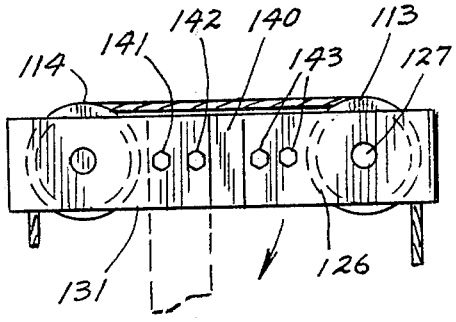
FIG. 11 is a fragmentary view taken generally along line 11—11 in FIG. 9.

The bracket 130 can be moved from its position shown in FIG. 9 in solid lines to the dotted line position which is the working position. In working position a junction plate 140 is bolted in position between the plates 126,126 as shown, and with one bolt indicated at 141 is fastened between the supports 130 and 131. A second bolt 142 is provided, to bolt the plate 140 to the bracket 131. When the pulley assembly unit is in its working position as shown in dotted lines in FIGS. 9 and 10, and in solid lines in FIG. 11 and the rest of the figures, these bolts are all in position and the pulleys 113 and 114 are held rigidly. However, when the silage is to be discharged out through the dormer portion 120, or when the operation is working near the top of the chute, the bolts 143 which connect the plate 140 to the straps 126 are removed, and the bolt 141 is also removed. Bolt 142 is loosened slightly to permit the plate 140 to pivot downwardly as shown in FIG. 11 in dotted lines, and this will disengage the straps 126 from the brackets 130 and 131, thereby permitting the bracket 131 to be pivoted to its position as shown in FIG. 9 with the pulley 114 out of the way of the silage being discharged. The funnel 26 is not then supported by rope 112.

The support 124 also mounts a switch support 150 that in turn mounts a suitable reversing switch 151 that can be controlled with a control arm 152 and cables extending down to ground level for operating the motor 75 for the winch assembly 70. The switch can be operated from the ground or any level in the chute to control the winch.

When the clean chute assembly is to be used with a silo that has the opening 121 and the plate 122 for discharging out through the dormer portion 120, the winch mount is made in a different manner, and as shown in FIG. 12 includes a pair of support posts 160,160 that are mounted in the tubes 66 which are connected to opposite ends of the tube 71. The posts 160 are bent inwardly toward the interior of the silo from the vertical axis of the tubes 66 so that the upper ends of posts 160 are spaced inwardly enough to provide clearance at the silo roof 20. A platform 163 is attached for supporting winch assembly 70. The winch assembly can be identical in construction to the previous form.

The posts 160 carry clevises 164 on which door frame assembly 30 can be mounted when discharge through the dormer is desired. Tube 103 and rod 100 may extend beyond frame member 31 and fasten into the clevises. Note the lower clevises 164 are extended in to vertically orient the frame assembly. The gooseneck and torque arm are held in the frame and the gooseneck aligns with the opening 122A in plate 122 for discharge of silage between legs 160 and below platform 163. The funnel 26 is mounted on plate 122 for discharging silage. As soon as the silage level in the silo is reduced, the frame assembly 30 is placed in the upper discharge door opening as previously described. A cover or door is used over opening 122A when it is not in use to seal the opening 122A.

It should be noted that even with a different winch mounted at the top of the silo, the operation of the frame assemblies 30, and the silo unloader would be the same for discharging out the discharge door openings.

The secret to providing a truly clean chute is to make it so that none of the normal debris and the like circulating inside the silo is permitted to get into the operator chute at any time. This means that all of the door openings in the silo are closed tightly all the time from the operator's passage, and also that the upper opening at the top of the roof or at the top of the dormer for the chute is sealed to prevent the chimney effect drafts from carrying debris up into the operator passage or chute from the bottom, as well as to prevent material from circulating into the top and down the chute to dirty it.

It can be seen in the present arrangement that the frame assembly 30 completely seals around the discharge door opening, and when the funnel or hood 26 is in position, everything is sealed with respect to the operator passageway portion of the silo chute surrounding the plastic tube and funnel. The only way that any silage material gets out of the silo is through the funnel 26 and the plastic tube 27, which prevents the material from contaminating the ladder rungs and other portions of the silo chute outside of the plastic tube.

Thus, in operation, the silo is generally filled to capacity. The removable doors are all closed before filling the silo and the unloader and frame 30 are hoisted to the top of the silo. Also the funnel 26 will be raised up out of the way. If the optional form of the silo is utilized the dormer at the top of the outer chute member is closed and silage can be piled up above the top edges of the silo wall. Then the silo unloader, which has been hoisted to the top of the silo during filling, and also the frame member 30 which is also stored at the top of the silo during filling, will be put into position to discharge out through the upper opening 122A through the funnel 26 and the plastic tube providing a clean chute.

Silage is discharged out through the dormer opening in the roof of the silo until the level of the silo has been reduced sufficiently so that the frame assembly can go in the uppermost one of the door openings. The pulley 114 will be pivoted out of the way when the dormer opening is used, as previously explained.

Assuming that the frame 30 is then placed in the uppermost one of the door openings, and the funnel 26 is put into position on the outside along with the plastic tube (the funnel of course would be suspended from the rope and pulleys 113 and 114 after the pulleys had been reassembled), the frame 30 will hold the gooseneck and torque tube in proper position to direct the silo right through the discharge opening 43 in the plate supported by the frame. Note that the gooseneck is held right at its outer end, and the space between the end of the gooseneck and the opening 43 is reduced to a minimum so that no silage will tend to hit against the sides of the opening, but will all discharge directly into the funnel 26 for clean and efficient operation.

The silage discharging by the unloader will take place in the normal manner, and the silo unloader will lower as it unloads. The gooseneck pivots on rod 100 and telescopes as previously described to accommodate the change in angle of the silo unloader relative to the support frame in the uppermost door. In larger silos, the silo unloader can be moved down so that the frame will be moved two or more doors each time it is moved. Assuming that the frame is to be lowered to another door, the clamp screws 58 at the lower part of the frame 30 are loosened, and the lower end of the frame is then pushed in slightly so that the frame will clear the lower edge of this door opening. The frame will be supported by the winch assembly 70 for this operation. The guide wheels are moved into their working position so that they roll against the inside surface of the door column, by pulling the lever downwardly. This will hold lower end of the frame assembly 30 away from the silo wall to guide the frame so that the frame does not tend to hook on irregularities or on a door opening that is to be passed during the lowering operation.

Of course, the funnel itself would have been removed prior to this time and supported on its rope and pulley assembly out of the way of the operator inside the clean chute. Then the winch assembly 70 at the top of the silo is operated to lower the frame assembly out of the door in which it has been used, until the operator can again see and remove the removable door 64 that is stored in the rack 60 at the top of the frame. The door 64 that was stored in the rack then can be replaced in the upper door opening. The operator then lowers the frame assembly 30 downwardly.

The door for the opening in which the frame assembly is to be placed will be cracked open by the operator from the outside and by looking up through a crack (the door is pushed inwardly into the silo) the operator can lower frame assembly 30 sufficiently far so that the storage rack is in position wherein the door for the new opening can be removed and placed onto the storage rack 60. The frame 30 thus is normally lowered down below the door opening in which it is to be placed so that the operator can remove the door from this opening and put it into the storage rack. After the door has been removed and placed in the storage rack, and fastened in place with the spring provided, the frame 30 is raised back upwardly and the upper end is tilted in so that the hook members will engage the upper edge of the door opening. Then the wheels 85 are moved to solid line position and the lower end of the frame is pulled through the door so that the flanges 36 fit against the inside surface of the silo. When this occurs the adjustable clamps 56 are put into place and screws 58 tightened down to clamp the frame 30 firmly into place. The frame is lifted slightly to pull hooks 50 tightly up against the upper edge of the door opening before the lower end of frame 30 is moved into the door opening. Then the funnel 26 is replaced on the outside of the plate 40 of frame assembly 30, the plastic tube 27 is cut off at its bottom end to have the proper length, and the unit is ready to go again.

It should be noted that the frame assembly can be manually lowered between door openings. The frame is attached to the gooseneck and torque arm.

A handle similar to that used in a snowblower or lawn mower can be attached to the frame, and used for manually moving the frame 30 downwardly. Of course the operator would have to go inside the silo to do this, in order to support the weight of the frame. However, then the winch and cable assembly 70 would not be necessary. The frame itself would still be used to support the gooseneck and torque restraining means positively in a door frame opening.

The frame assembly 30 is quickly removable, and quickly replaced and provides a positive location for the discharge gooseneck or conduit of the silo unloader and also for the torque arm. The frame is adjustable in size to fit openings, and the clamping devices are quick release and easy refastened when desired.

Thus, variations of the exact form of the invention shown can be made, but the process is simple in any event, and the frame assembly, which is adjustable, provides a defined fixed opening by having a plate mounted in the frame. A positive positioning support for both the gooseneck and torque arm of the silo unloader simplifies greatly the installation, moving, and use of silo unloaders.

It should also be noted that the sealing of the silo openings to prevent material from the inside of the silo from coming out into the clean chute assembly is enhanced with the flanges 36 that fit on the inside of the silo and are attached to the frame 30. Additionally, the plate 40 and its spacers or fillers 37 alongside the plate block the opening for the door of the silo and define a set discharge opening with the gooseneck and torque arm positively positioned in relation to this discharge opening to insure that the silage is directed right directly through the opening, and is not directed against the plate or in some other way against a member that would block the silage discharge path.

The frame 30 may hold only one or both of the radial members of the silo unloader, namely the gooseneck and the torque arm in position.

What is claimed is:

1. A movable door frame for silage discharge door openings of a silo, said door frame being movable from door opening to door opening vertically in the silo and comprising a perimeter frame member including side frame members that extend generally uprightly along the upright side edges of a door opening in which the frame is to be used, and cross frame members, adjustable coupling means between said cross frame members and said upright members to permit adjustment of the lateral width of said side frame members, means for positioning the door frame within a door opening, releasable latch means to releasably hold the perimeter frame member in a fixed position in a door opening, said perimeter frame member including means to mount and position thereon components of mechanical silage discharge mechanisms to thereby direct silage being discharged to precise locations in relation to the door opening.

2. The door frame of claim 1 and flange means on said upright frame members to prevent the door frame member from passing from the interior of the silo through the door opening when clamped in a door opening.

3. The combination as specified in claim 1 and plate means fitting within said frame member and defining a desired opening smaller than said door opening, and means for removably mounting a discharge funnel on the exterior of said plate means.

4. The frame member of claim 1 and flange means along the side edges of said frame member positioned to engage the interior surface of silo adjacent the silo door opening to prevent the frame from passing outwardly through the associated door opening.

5. The combination as specified in claim 1 and winch means on the interior of the silo, means to mount said winch means to a silo wall above the door openings of the silo, said winch means including a cable, and means to attach said cable to said door frame to permit said door frame to be raised and lowered under power of said winch means.

6. The combination as specified in claim 1 and said frame further includes a door carrying support means adjacent an upper edge thereof for receiving and holding a silo door normally used to close the door opening in which said door frame is to be placed.

7. In combination with a silo unolader having a discharge chute having an outer end for discharging silage from the interior of silo having a silo wall and a plurality of silage discharge door openings, a movable door frame for silage discharge door openings defined in a wall of a silo, said door frame being movable from door opening to door opening vertically in the silo and comprising a perimeter frame member including means for positioning the door frame within said door opening, comprising means to prevent the frame from moving outwardly through the door opening in which it is placed a pair of retainer members having upwardly extending outer ends mounted on the door frame and positioned to fit to the outside of the silo wall and which engage the outer surface of the silo wall adjacent the upper edge of the door opening in which the door frame is placed, plate means mounted within said perimeter frame member and defining a desired opening smaller than said door opening, means for removably mounting a discharge funnel on the exterior of said plate means, means to pivotally mount the outer end of said chute to the perimeter frame member for pivotal movement about a generally horizontal pivot axis immediately above and adjacent said opening defined in said plate means, said silo unloader further including a torque arm assembly, and means separate from the means to mount said discharge chute to pivotally mount said torque arm to said door frame so that said discharge chute and torque arm assembly may pivot downardly from a first position as silage is discharged from a silo and said silo unloader moves downwardly.

8. The combination as specified in claim 7 wherein said retainer members have sufficient length in upward direction to permit the door frame to move toward the upper edge of a door opening in which the door frame is to be placed sufficiently far to permit the lower side of said door frame to fit into the door opening subsequent to placement of said retainer members at the upper edge of the door opening.

9. For use in a cylindrical silo having a perimeter wall and a column of vertically aligned individual door openings for silage discharge, and used in combination with a mechanical surface silo unloader having at least one radially extending member extending to position adjacent a door opening, each of said door openings having an openable door member normally closing said openings, and means defining a clean discharge chute section within said first mentioned chute, the improvement comprising a removable door frame and detachable funnel means for providing guide and support means for a silo unloader and a passageway for discharge of silage through the door openings, said door frame comprising a door frame member adapted to fit inside door openings of said silo, latch means to removably latch said door frame in position relative to the silo with the frame guided in said door opening, flange means on said door frame on the interior of said silo to prevent the door frame from passing outwardly through the door opening but permitting the door frame to be moved toward the interior of the silo, said door frame including a plate member to close the normal door opening of the silo and said plate having a preselected size opening therethrough, means on the exterior of said plate to removably mount said funnel in alignment with said preselected opening.

10. The assembly of claim 9, said funnel member having an inlet opening mating with said preselected opening, and a flange around the inlet opening of said funnel to seat on the exterior of said plate member.

11. The assembly of claim 9 wherein the silo has a dome roof above the upper edge of the silo wall, an opening defined in the dome roof for discharging silage therethrough, a winch member on the interior of said silo above the upper edges of the silo wall for raising and lowering said frame member, and means to support said winch member comprising a pair of support legs mounted on the silo wall and spaced apart sufficiently to permit silage to be discharged between said legs and being of sufficient length to support said winch member above the upper edge of said silo to permit silage to be discharged below the winch member through the discharge opening in said dome roof.

12. For use in an upright silo having a perimeter wall, a plurality of individual door openings forming a door column in said silo for discharge of silage from the silo, a first upright chute member mounted on said wall and forming a generally U shaped configuration overlying said door column, each of said door openings having a removable door member normally closing the respective door opening, and a dome roof on said silo, said roof having a first opening defined therein above said door column, the improvement comprising a plate mounted in said first opening, said plate having a second opening therethrough, flexible seal means mounted between said plate and portions of said roof adjacent said first opening to support the plate relative to said roof, and means to mount a silo funnel on the exterior of said plate in position aligned with said second opening to permit discharge of silage through the second opening and a funnel supported on said plate.

13. The combination of claim 12 wherein a winch member is positioned on the interior of said silo above the upper edge of the silo wall, and means to mount said winch member comprising a pair of legs spaced apart sufficiently and of sufficient length to permit silage to be discharged below said winch member and between said legs and out the opening in said roof.

14. The combination of claim 13 and a pulley member mounted on the exterior of said silo below the roof opening, said pulley member being spaced from the silo wall and carrying a rope for hoisting said funnel when the funnel is below the level of said roof, and means to pivotally mount said pulley member to permit the pulley to be pivoted to position adjacent the silo wall.

15. For use in an upright cylindrical silo having a perimeter wall and a column of vertically aligned individual door openings for silage discharge, and a silo unloader in the silo for discharging silage through the door openings, said silo unloader having a generally radially extending discharge chute and a generally radially extending torque arm both extending to position outer ends thereof adjacent the door openings, the improvement comprising a removable door frame positionable selectively in each of said door openings, said door frame comprising upright side frame members adapted to fit inside door openings of said silo and providing a silage discharge frame opening, latch means to removably latch said door frame in position relative to the silo with the door frame guided in said door opening, means on the door frame to separately support the outer ends of said radially extending members in position fixed from rotational movement around the silo and pivoted to the door frame about a generally horizontal axis.

16. The apparatus of claim 15 wherein said door frame includes upper and lower cross members, means to adjustably support said side frame members on said cross members to permit changing the lateral width of said side frame members, and plate means mounted to said cross supports, said plate means having an opening defined therein through which silage is discharged.

17. In combination with a silo unloader having a discharge chute for discharging silage from the interior of a silo having a silo wall and a plurality of silage discharge door openings defined through the wall, a movable door frame for the discharge door openings of the silo, said door frame being movable from a door opening into the silo and to a different door opening vertically in the silo and comprising a perimeter frame member including means for positioning the door frame within a door opening, means defining an outlet opening through the perimeter frame member, releasable latch means to releasably hold the perimeter frame member in a fixed position selectively in each door opening, said perimeter frame member including means to pivotally mount the discharge chute on the frame member about a generally horizontal axis immediately above and adjacent the outlet opening and on the interior of the silo to direct silage discharged through the outlet opening, said discharge chute thereby being permitted to pivot downwardly from a first position as silage is discharged from a silo and as said silo unloader moves downwardly and while retaining the chute in position to discharge silage through the outlet opening.

18. The combination of claim 15 or 17 and an axle assembly mounted on the door frame adjacent the lower portion of the door frame, wheel means on the axle assembly, and means to move the axle assembly to a first position wherein the wheel means engage the interior of the silo wall and hold the lower end of the door frame spaced from the interior of the silo wheel, and being movable to a second position wherein the wheel means are spaced from the interior of the silo wall when the door frame is in a door opening.

* * * * *